US011198487B1

(12) United States Patent
Walz et al.

(10) Patent No.: US 11,198,487 B1
(45) Date of Patent: Dec. 14, 2021

(54) BUOYANT SUN PROTECTION DEVICE

(71) Applicants: Karen Walz, The Villages, FL (US); Charles Walz, The Villages, FL (US)

(72) Inventors: Karen Walz, The Villages, FL (US); Charles Walz, The Villages, FL (US)

( * ) Notice: Subject to any disclaimer, the term of this patent is extended or adjusted under 35 U.S.C. 154(b) by 0 days.

(21) Appl. No.: 17/462,194

(22) Filed: Aug. 31, 2021

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02; A45B 23/00
USPC ..... 114/361; 135/16, 96, 124
See application file for complete search history.

(56) References Cited

U.S. PATENT DOCUMENTS 2,932,833 A * 4/1960 Wambach ..... A47G 9/1045 135/96
4,799,910 A * 1/1989 Kellough ..... A47C 15/006 441/131
5,299,588 A 4/1994 MacLeod
5,690,133 A 11/1997 Capwell
5,769,022 A * 6/1998 Luxford ..... B63B 17/02 114/361
6,062,243 A 5/2000 Tuch et al.
6,209,149 B1 * 4/2001 Song ..... E04H 4/0025 441/38
7,314,399 B2 * 1/2008 Turner ..... B63B 17/02 441/129
8,371,321 B2 2/2013 Affolter
8,485,206 B1 7/2013 Rose
D725,424 S 3/2015 Cohen

* cited by examiner

*Primary Examiner* — Lars A Olson
(74) *Attorney, Agent, or Firm* — Mitchell J. Mehlman, Esq.

(57) ABSTRACT

Buoyant sun protection devices have a canopy are provided. A connecting structure has a longitudinal member connected to a first and second elbow. The elbows are connected to first and second crossmembers. The crossmembers each having a distal end attached to a first and a second end cap. A first float has an aperture therethrough. The first float is sized to fit over the longitudinal member. An arc float includes a portion having an aperture centered therein. The aperture includes an outer wall sized to fit around the first and second end caps and the crossmembers. The arc float includes at least two cutouts. A rotatable sun protection canopy is attached to the cross members in the area of the at least two cutouts for surrounding a user within a with a buoyant sunshade.

20 Claims, 6 Drawing Sheets

BUOYANT SUN PROTECTION DEVICE

BACKGROUND OF THE INVENTION

The instant invention relates buoyant devices that include mechanisms such as collapsible or adjustable canopies for protecting the user from harmful solar radiation and the elements. The invention relates more specifically to buoyant mechanical devices including sun blocking apparatus designed to be used by a human during swimming or recreation in a pool or another body of water.

Floating devices such as floating pool chairs are known. Fabric-covered inflatable pool chairs featuring an integrated backrest and a mesh seat that suspends the lower body just below the water's surface are known. Some devices include an inner spring around the outside edge of the float to provides stability in the water. Some floats are inflatable and may include valves for inflation and deflation. For example:

U.S. Pat. No. 5,299,588 discloses a combination of a sunshade and a floatable support member or platform for the sunshade for use in swimming pools or the like. The floatable support member is adapted to serve as a seat for a person or the floatable support member is adapted to serve as a refreshment stand or convenient storage facility.

U.S. Pat. No. 5,690,133 discloses a floating sun shield apparatus that includes a frame having oppositely disposed longitudinal frame members and oppositely disposed transverse frame members. The frame members have a perimeter defining a user area. Also included is a canopy operatively coupled to the frame and disposed over the user area where the canopy is configured to block sunlight from the user area. Two flexible canopy support rods releasably attach to the frame at opposite ends substantially forming an arch where each support rod is configured to attach to either the longitudinal frame members or to the transverse frame members such that the canopy support rods are maintained in a flexed convex orientation relative to the frame. The canopy has opposite longitudinal sides configured to engage the canopy support rods such that the canopy is maintained in a curved orientation above the user area. The frame is configured to be buoyant in water such that the canopy is maintained above the user area.

U.S. Pat. No. 6,062,243 discloses a floating shelter having a semicircular frame defining an open-ended tunnel with an unobstructed ingress and egress. The frame has straight frame members forming the base of the open-ended tunnel. The roof of the open-ended tunnel is formed by curved frame members working together with a canopy top. A tensioning assembly mounted to each bottom corner of the canopy top engages the curved frame members forming the entrance and exit of the tunnel. Floats are fitted about the straight frame members forming the base of the open-ended tunnel for flotation of the frame.

U.S. Pat. No. 8,371,321 discloses a free-floating canopy shade system for use in a pool or at a beach. The canopy has four legs each leg supported by an open top float, each float having an outer tapered cylindrical wall and an inner cylindrical wall, the inner cylindrical wall being sized to receive a leg, an attachment to attach the leg to the float. The float being water tight and open at the top. Wherein an open shaded area is created beneath the canopy bounded only on four corners by each float.

U.S. Pat. No. 8,485,206 discloses a sun shade designed for portability and selective angular orientation in a body of water. The device comprises an umbrella portion, together with at least two distally joined buoyant members to keep the umbrella from sinking. The umbrella portion's cover comprises generally opaque material to keep the sun's rays from penetrating. The user orients the expanded umbrella towards the sun and allows the umbrella to float on the buoyant members while the user is below the umbrella. The shape and selective angular orientation of the sun shade enable the user to block rays of the sun from 0 degrees to 90 degrees relative to the surface of the water.

The present invention provides numerous advantages over known devices. The instant invention combines the utility and convenience of a buoyant mobile floatation device and includes the capability of an adjustable shade canopy for protecting the user from the elements while the user stands, floats or swims within a "D shaped" user area within a buoyant float assembly.

SUMMARY OF THE INVENTION

In one aspect of the invention a buoyant sun protection device is disclosed. The device includes a connecting structure having a longitudinal member connected to a first and second tubular. The first and second tubular are connected to a first and a second crossmember respectively. The first and second crossmembers each have a distal end attached to a first and a second end cap, respectively. A first float has an aperture therethrough. The first float has a diameter D and a length L. The aperture has an outer diameter D'. The first float is sized to fit over the longitudinal member of the connecting structure. An arc float includes a portion having an aperture centered therein. The aperture has an outer wall and is sized to fit around the first and second end caps and the crossmembers. The arc float includes at least two cutouts. A sun protection canopy can be attached to the cross members in the area of the at least two cutouts.

In some embodiments, the longitudinal member can be a cylindrical tube, the first and second elbows can be tubular, the first float can be cylindrical; and the arc float can be cylindrical.

In one embodiment of this aspect, the ratio of D to D' is between about 10% and about 60%.

In some embodiments of this aspect, the ratio of D to D' is between about 20% and about 40%.

In certain embodiments, the first and second elbows include flanged portions to center the first float between the first and second elbows.

In some embodiments of this aspect, the sun protection canopy is attached to the crossmembers at a point between about 40% and about 60% of a distance A between the end caps and the elbows.

In certain embodiments, the sun protection canopy is attached to the crossmembers at a point between about 48% and about 52% of a distance A between the end caps and the elbows.

In a particular embodiment of this aspect, the ratio of a length L' of the arc float to the length L of first float is between about 6:1 and about 2:1, thereby forming a letter "D" shape having an opening for the user therein.

In some embodiments, the ratio of a length L' of the arc float to the length L of first float is between about 2:1 and about 3:1.

In other embodiments, the canopy includes first and second structural members for attaching a flexible sunshade material therebetween.

In certain embodiments, the flexible sunshade material has a sun protection factor (SPF) of at least 50.

In one embodiment, the structural members are each connected to an attachment bracket. The attachment bracket includes a tubular portion which can be snap fit onto the crossmembers via the at least two cutouts.

In another embodiment, the attachment bracket includes a circular portion for attaching the structural members using a fastener. The circular portion allows for rotation of the canopy about an axis R of the fastener.

In some embodiments, the canopy includes a bracket for locking the canopy in an open position or for collapsing the canopy to a closed position. The bracket can be attached to the structural members using fasteners.

In another non-limiting aspect of the present invention a buoyant sun protection device includes a connecting structure. The connecting structure has a longitudinal member connected to a first and second elbow. The first and second tubular are also connected to a first and a second crossmember respectively. The first and second crossmembers each have a distal end attached to a first and a second end cap, respectively. A first float has an aperture therethrough. The first float has a diameter D and a length L. The cylindrical aperture has and outer diameter D'. The first float can be sized to fit over the longitudinal member of the connecting structure. An arc float includes a portion having an aperture centered therein. The aperture has an outer wall sized to fit around the first and second end caps and the crossmembers. The arc float includes at least two cutouts. A sun protection canopy can be attached to the cross members in the area of the at least two cutouts. The first and second elbows can include flanged portions to center the first float between the first and second elbows.

In some embodiments of this aspect, the longitudinal member can be a cylindrical tube, the first and second elbows can be tubular, the first float can be cylindrical; or the arc float can be cylindrical.

In other embodiments, the ratio of D to D' is between about 10% and about 60%.

In other embodiments, the ratio of D to D' is between about 20% and about 40%.

In certain embodiments, the sun protection canopy is attached to the crossmembers at a point between about 40% and about 60% of a distance A between the end caps and the first and second elbows.

In some embodiments, the sun protection canopy is attached to the crossmembers at a point between about 48% and about 52% of a distance A between the end caps and the first and second elbows.

In particular embodiments, the ratio of a length L' of the arc float to the length L of the first float is between about 6:1 and about 2:1, thereby forming a letter "D" shape having an opening for a user therein.

In alternate embodiments, the ratio of a length L' of the arc float to the length L of the first float is between about 2:1 and about 3:1.

DETAILED DESCRIPTION

Figure 1:
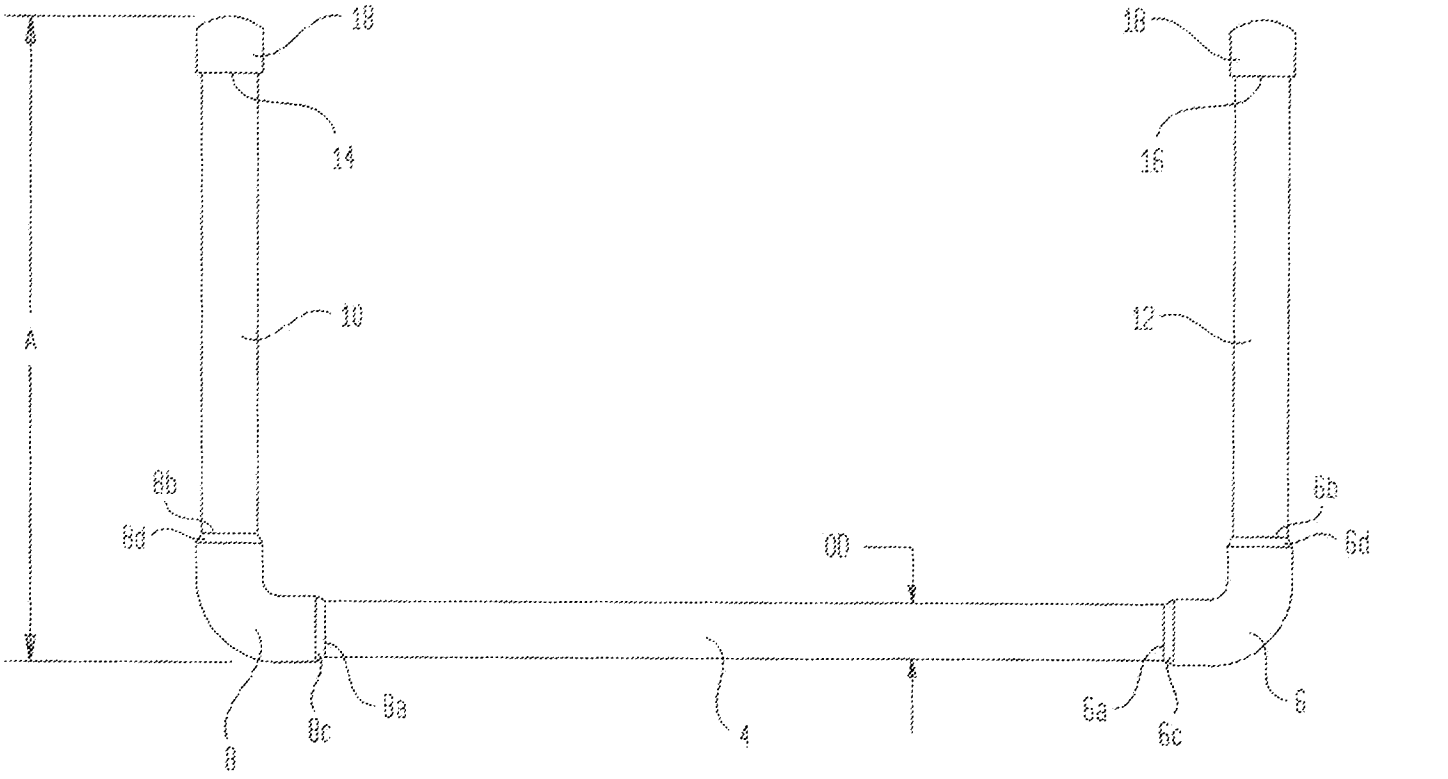
FIG. 1 is plan view of some of the structural elements of one embodiment of the buoyant sun protection device included in the present invention.
Figure 2:
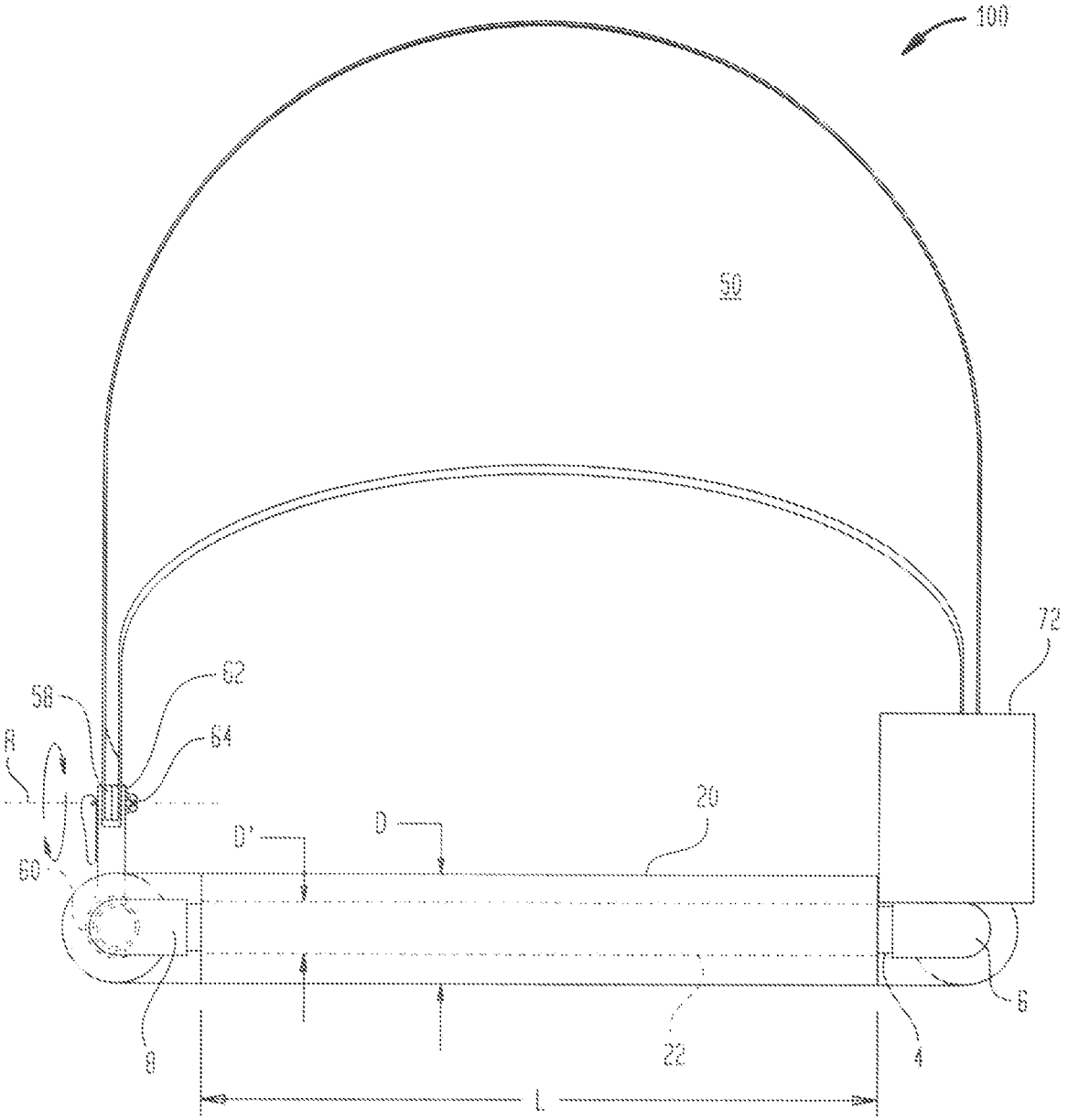
FIG. 2 is a front view of some of the elements of the device according to one embodiment of the present invention.
Figure 3:
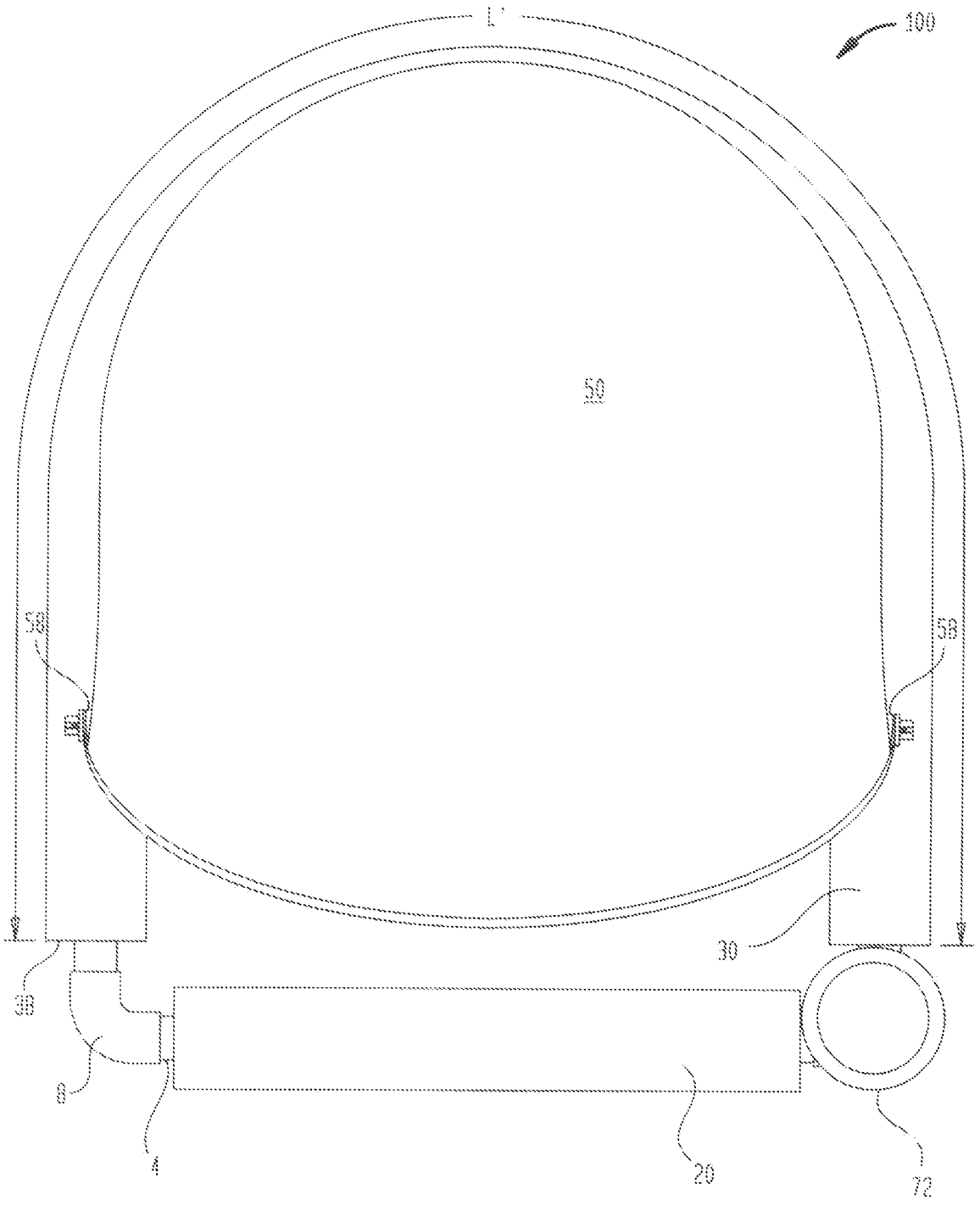
FIG. 3 is a top view depicting some of the elements of an embodiment of the buoyant sun protection device.
Figure 4B:
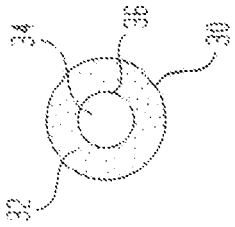
FIGS. 4A and 4B are a side view and cross-sectional view respectively, depicting some of the elements included in an embodiment of the buoyant sun protection device.
Figure 4A:
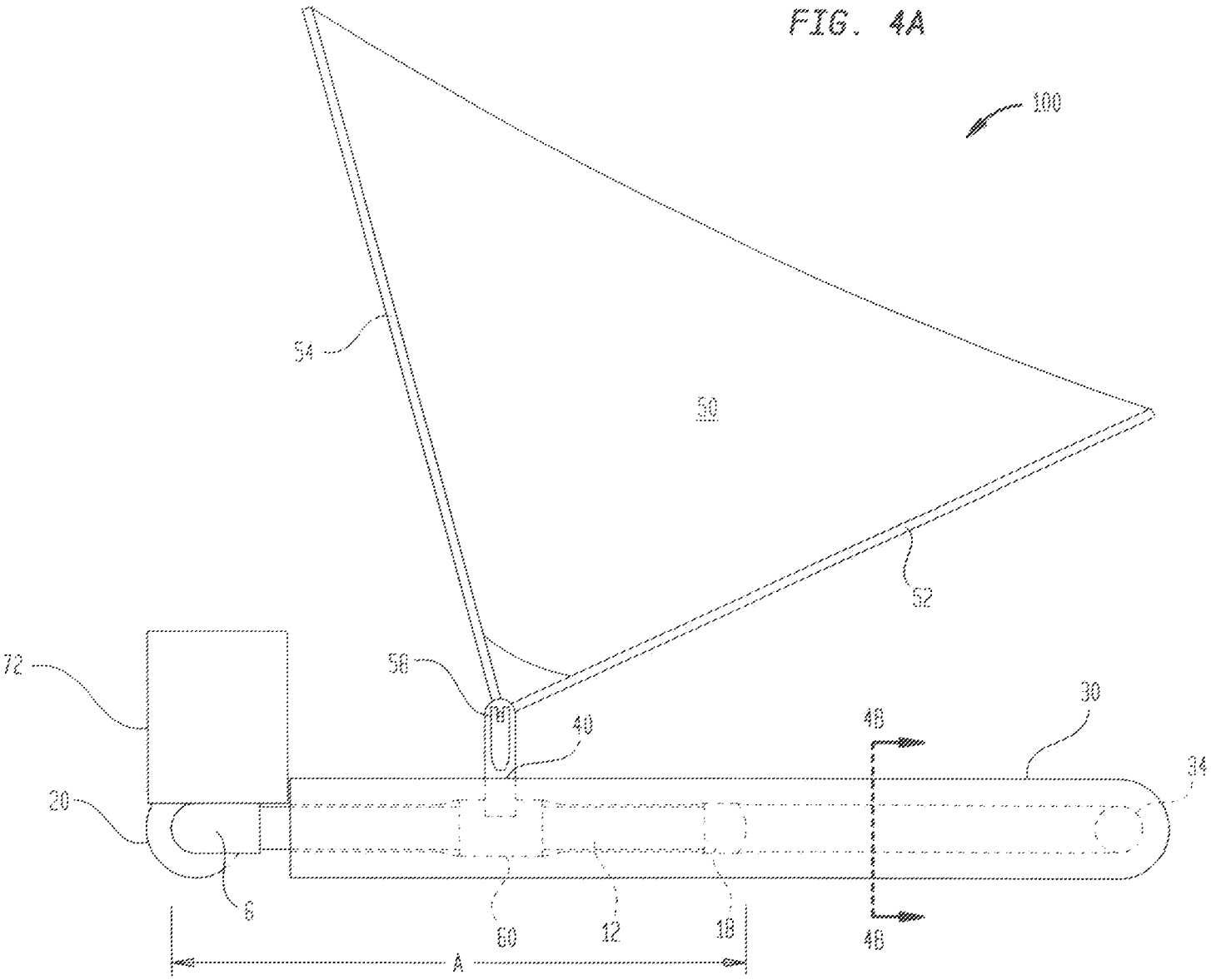
Figure 5:
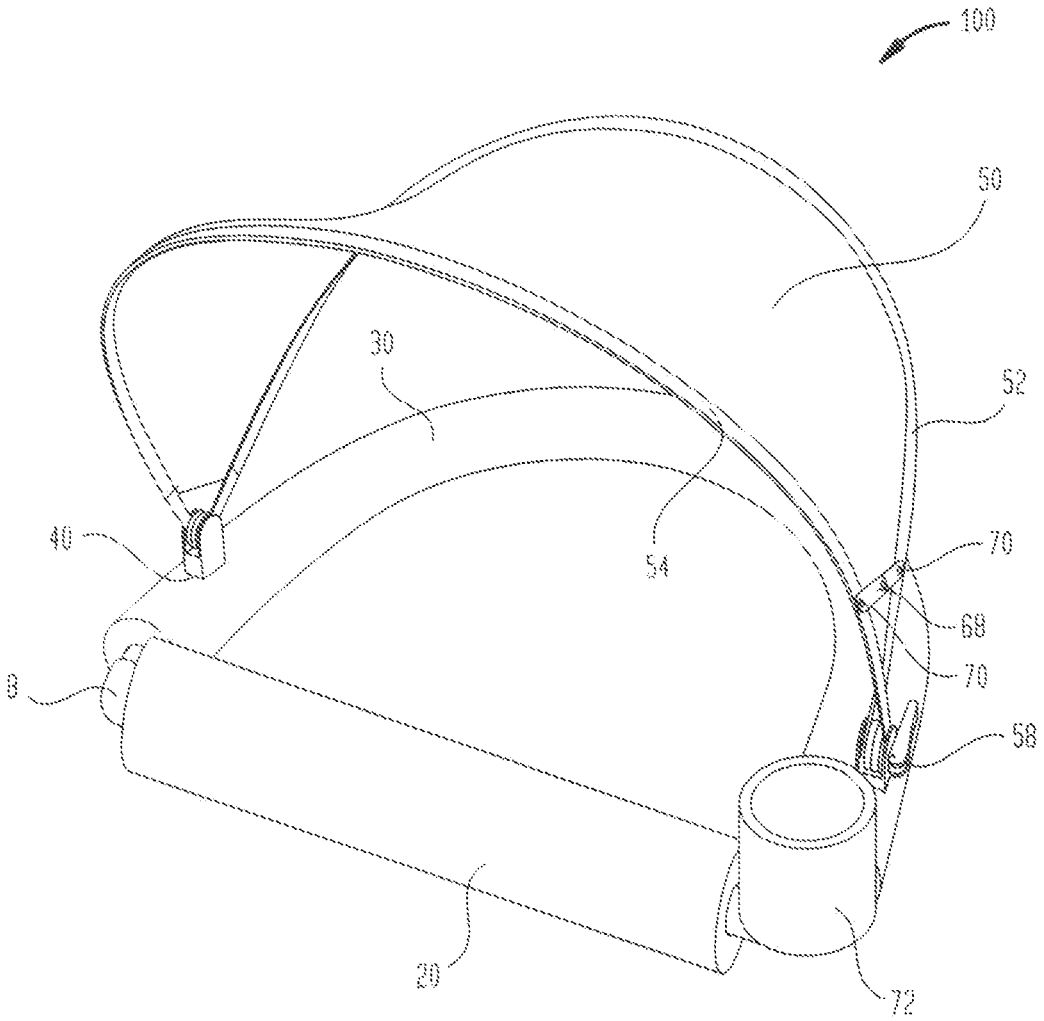
FIG. 5 is an isometric view depicting some of the elements included in an embodiment of the buoyant sun protection device.
Figure 6:
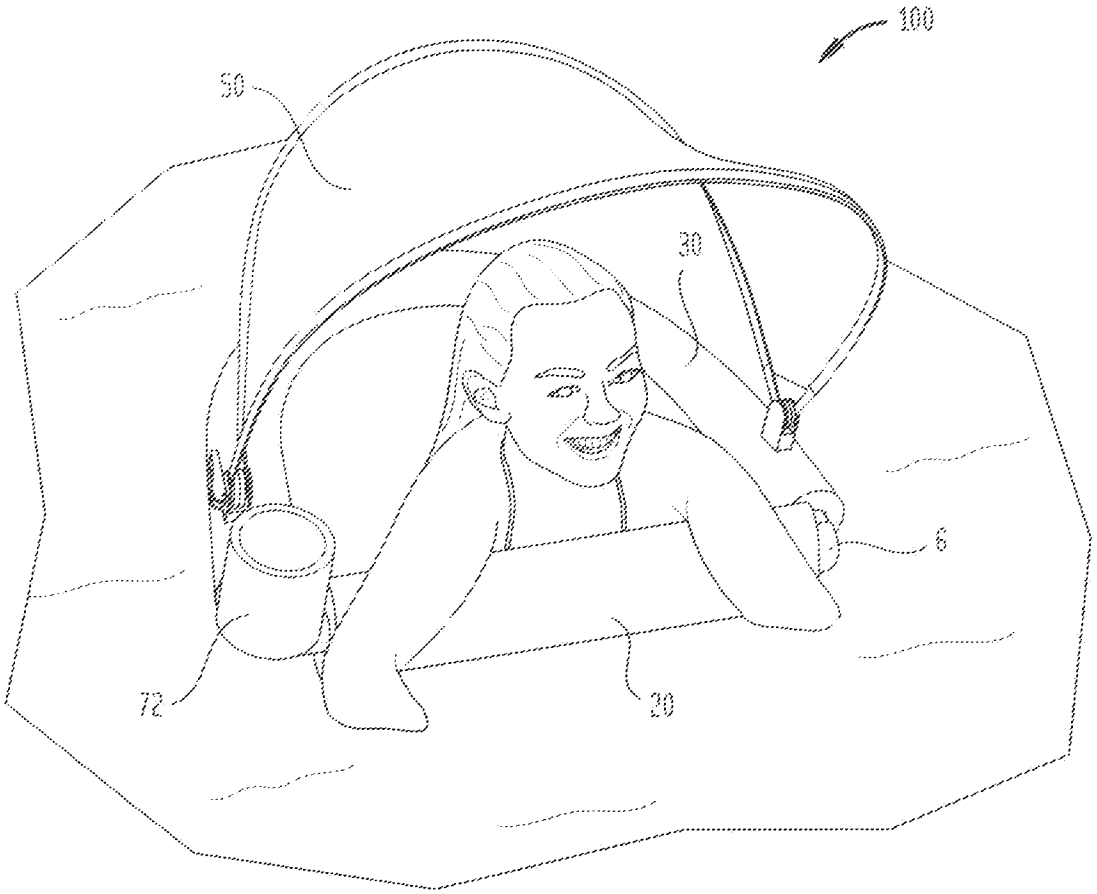
FIG. 6 is isometric view depicting some of the elements included in an embodiment of the buoyant sun protection device including a user floating in water.

In one non-limiting embodiment of the present invention as shown in FIGS. 1-6, a buoyant sun protection device 100 includes a connecting structure 2, having a structural member, shown here by way of example, in the form of a longitudinal hollow cylindrical tube 4. The tube 4 has an outer diameter OD and is connected to first and second tubular elbows 6, 8. Each elbow 6,8, includes a first end 6A, 8A and a second end 6B, 8B. The first and second ends 6A, 6B, and 8A, 8B are substantially perpendicular to one another. The second ends 6B, 8B are connected to crossmembers 10,12 respectively which are substantially parallel to one another. Crossmembers 10,12 are each having a distal end 14, 16 are connected to end caps 18.

The connecting structure 2 can have portions that solid or hollow and can be made from any material that allows the device to be buoyant in water. Any shape cross-section (e.g., cylinder, polygon, and the like, or any combination thereof) is contemplated to be within the scope of the present invention.

A first float 20, comprises a buoyant tubular polymer foam, such as polyethylene foam. Any buoyant material can be used. The first float 20, can be shaped like a cylinder having an outer diameter D and having a length L. The first float 20 can include a cylindrical aperture 22 having an outer diameter D' centered on diameter D and running the length L. The ratio of D to D' can be between about 10% and about 60%. Preferably the ratio is between about 20% and about 40%.

The first float 20, is sized to fit such that the outer diameter D' of aperture 22 abuts the outer diameter OD of tube 4 along the length L. The elbows, 6,8 can include flanged portions 6C, 6D, 8C, and 8D which act in part to keep the first float 20 centered between the elbows 6,8. The first float can have portions that solid or hollow and can be made from any buoyant material or any shape cross-section (e.g., cylinder, polygon, or any combination thereof).

Arc float 30 includes a solid cylindrical portion 32 having a circular aperture 34 centered therein. The aperture 34 has an outer wall 36. The aperture 36 is sized to fit around the end caps 18 and the crossmembers 10,12 such that the ends 38 of the arc float 30 about the flanged portions 6D, 8D of the elbows 6,8. Arc float 30 include two cutouts 40 which are used to attach a sun protection canopy 50 to the cross members 10,12. The arc float can have portions that solid or hollow and can be made from any buoyant material. The arc float can have portions that solid or hollow and can be made from any buoyant material or any shape cross-section (e.g., cylinder, polygon, or any combination thereof).

The sun protection canopy 50 can be attached to the crossmembers 10,12 at a point between about 40% and about 60% of the distance A between the end caps 18 and the elbows 6,8. In a preferred embodiment the distance D is between about 48% and about 52%.

The ratio of length L' of the arc float to the length L of first float can be between about 6:1 and about 2:1 thus forming a letter "D" shape having an opening for the user therein. Preferably the length L' of the arc float to the length L of first float is between about 2:1 and about 3:1. The D shape allows the user (see FIG. 6) to be surrounded by buoyant floats on all sides and in a defined area under canopy 504 for sun protection.

Canopy 50 includes structural members 52 and 54 for attaching a flexible sunshade 56 therebetween. The canopy 50 can be configured such that the sunshade 56 is concave or convex between the structural members 52,54. The structural members 52,54 are each connected to an attachment bracket 58. In one embodiment, the attachment bracket 58 includes a tubular portion 60 which can be snap fit onto the crossmembers 10, 12 via the cutouts 40. The attachment bracket 58 can also include an adjustable portion 62, for attaching the structural members 52,54 using a fastener 64. This feature allows for rotation of the canopy 50 in both a closed position or an open position about the axis R of the fastener 64 while the canopy 50 is connected to the structure 2. Optionally, the canopy 50 can include a bracket 68 for locking the canopy 50 in an open position or for collapsing the canopy 50 to a closed position used for storage, travel, or when the canopy 50 is not required for protection. The bracket 68 can be attached to the structural members 52,54 using fasteners, 70.

In use, a user can float within the "D shaped" user defined area formed between the arc float 30 and the front float 20. The user's arm can be supported by the arc float 30 while the user is in a comfortable position. The use can adjust the canopy 50 to a plurality of angles between 0 and 180 degrees thereby conveniently blocking harmful UV radiation of the sun as needed under the particular circumstances of the user.

In some embodiments one or more cup or bottle holders 72 can be attached proximate to the arc float or front float. The one or more cup or bottle holders can be insulated, for example, using a buoyant foam insulation material.

The front and arc floats can be constructed from pool "noodle" materials. A pool noodle is a cylindrical piece of flexible, typically made from buoyant polyethylene foam. The most common dimensions for off the shelf noodles are about 6 feet in length and about 3 in in diameter. Any shape, size and color "noodle" is contemplated to be within the scope of the instant invention. Further, any buoyant polymeric material may be utilized for floatation. The floats may include a cylindrical exterior surface, or other geometries, including a combination of cylindrical and other shapes.

Additionally, the floats used herein can include hollow portions where internal structure is required and solid portions where no internal structure is necessary. The internal structure can be fabricated using any polymeric piping material such as PVC. Further, the any desirable color can be used for the float(s) and/or the connecting structure and canopy.

The canopy shade can include any type of fabric, cloth, mesh and the like to provide a specified range of sun protection. It is desirable for the canopy shade to have an SPF (sun protection factor) of at least 50 thereby protecting a user's skin from 98% of the UVB "burning" rays that penetrate and can damage the skin.

Although the invention herein has been described with reference to particular embodiments, it is to be understood that these embodiments are merely illustrative embodiments and that other arrangements may be devised without departing from the spirit and scope of the present invention as defined by the disclosure herein.

What is claimed is:

1. A buoyant sun protection device comprising:

(a) a connecting structure including a longitudinal member connected to a first and a second elbow; said first and second elbows also being connected to a first and a second crossmember respectively, the first and second crossmembers each having a distal end attached to a first and a second end cap, respectively;

(b) a first float having an aperture therethrough, the first float having a diameter D and a length L, the aperture having an outer diameter D', the float being sized to fit over the longitudinal member of the connecting structure;

(c) an arc float, the arc float including a portion having an aperture centered therein, the aperture including an outer wall sized to fit around the first and second end caps and the crossmembers, the arc float including at least two cutouts;

(d) a sun protection canopy, the canopy being attached to the cross members in the area of the at least two cutouts.

2. The buoyant sun protection device of claim 1, wherein the longitudinal member is a cylindrical tube, the first and second elbows are tubular, the first float is cylindrical; and the arc float is cylindrical.

3. The buoyant sun protection device of claim 1, wherein the ratio of D to D' is between about 10% and about 60%.

4. The buoyant sun protection device of claim 1, wherein the first and second elbows include flanged portions to center the first float between the first and second elbows.

5. The buoyant sun protection device of claim 1, wherein the sun protection canopy is attached to the crossmembers at a point between about 40% and about 60% of a distance A between the end caps and the elbows.

6. The buoyant sun protection device of claim 1, wherein the sun protection canopy is attached to the crossmembers at a point between about 48% and about 52% of a distance A between the end caps and the elbows.

7. The buoyant sun protection device of claim 1, wherein the ratio of a length L' of the arc float to the length L of first float is between about 6:1 and about 2:1, thereby forming a letter D-shape having an opening for the user therein.

8. The buoyant sun protection device of claim 1, wherein the ratio of a length L' of the arc float to the length L of first float is between about 2:1 and about 3:1.

9. The buoyant sun protection device of claim 1, wherein the canopy includes a first and a second structural member having a flexible sunshade material connected therebetween.

10. The buoyant sun protection device of claim 9, wherein the flexible sunshade material has a sun protection factor (SPF) of at least 50.

11. The buoyant sun protection device of claim 9, wherein the structural members are each connected to an attachment bracket, the attachment bracket includes a tubular portion, the tubular portion can be snap fit onto the crossmembers via the at least two cutouts.

12. The buoyant sun protection device of claim 9, wherein the attachment bracket includes a circular portion for attaching the structural members using a fastener, the circular portion allowing for rotation of the canopy about an axis R of the fastener.

13. The buoyant sun protection device of claim 9, wherein the canopy includes a bracket, the bracket can lock the canopy in an open position or a closed position, the bracket being attached to the structural members using fasteners.

14. A buoyant sun protection device comprising:

(a) a connecting structure including a longitudinal member connected to a first and a second elbow; the first and second elbows also being connected to a first and a second crossmember respectively, the first and second crossmembers each having a distal end attached to a first and a second end cap, respectively;

(b) a first float having an aperture therethrough, the first float having a diameter D and a length L, the aperture having and outer diameter D', the first float being sized to fit over the longitudinal member of the connecting structure;

(c) an arc float, the arc float including a portion having an aperture centered therein, the aperture including an outer wall sized to fit around the first and second end caps and the crossmembers, the arc float including at least two cutouts; and (d) a sun protection canopy, said canopy being attached to the cross members in the area of the at least two cutouts, wherein the first and second elbows include flanged portions to center the first float between the first and second elbows.

15. The buoyant sun protection device of claim 14, wherein the longitudinal member is a cylindrical tube, the first and second elbows are tubular, the first float is cylindrical; and the arc float is cylindrical.

16. The buoyant sun protection device of claim 14, wherein the ratio of D to D' is between about 10% and about 60%.

17. The buoyant sun protection device of claim 14, wherein the sun protection canopy is attached to the crossmembers at a point between about 40% and about 60% of a distance D between the end caps and the first and second elbows.

18. The buoyant sun protection device of claim 14, wherein the sun protection canopy is attached to the crossmembers at a point between about 48% and about 52% of a distance D between the end caps and the first and second elbows.

19. The buoyant sun protection device of claim 14, wherein the ratio of a length L' of the arc float to the length L of first float is between about 6:1 and about 2:1, thereby forming a letter D-shape having an opening for a user therein.

20. The buoyant sun protection device of claim 14, wherein the ratio of a length L' of the arc float to the length L of the first float is between about 2:1 and about 3:1.

* * * * *